United States Patent [19]

Acar

[11] Patent Number: 4,567,471

[45] Date of Patent: Jan. 28, 1986

[54] MONITORING SYSTEM

[75] Inventor: Mustafa Acar, Syosset, N.Y.

[73] Assignee: Pittway Corporation, Syosset, N.Y.

[21] Appl. No.: 521,615

[22] Filed: Aug. 8, 1983

[51] Int. Cl.[4] ..... G08B 29/00

[52] U.S. Cl. ..... 340/513; 340/505; 340/508; 340/510; 340/511; 340/518

[58] Field of Search ..... 340/513, 506, 508, 505, 340/510, 511, 518, 521, 526, 531, 825.06, 825.07, 825.08, 825.1, 825.54

[56] References Cited

U.S. PATENT DOCUMENTS

| | | | |
|---|---|---|---|
| 3,518,655 | 6/1970 | Saul | 340/542 |
| 4,117,479 | 9/1978 | Galvin et al. | 340/502 |
| 4,118,700 | 10/1978 | Lenihan | 340/524 |
| 4,218,677 | 8/1980 | Wilson, Jr. et al. | 340/506 |
| 4,257,037 | 3/1981 | Mongeon | 340/533 |
| 4,270,121 | 5/1981 | Verr | 340/514 |
| 4,274,087 | 6/1981 | Swanson et al. | 340/525 |
| 4,369,436 | 1/1983 | Lautzenheiser | 340/508 |
| 4,423,410 | 12/1983 | Galvin et al. | 340/506 |
| 4,435,700 | 3/1984 | Alley | 340/506 |

*Primary Examiner*—Donnie L. Crosland

[57] ABSTRACT

A monitoring system for a protection loop that has a plurality of switches in series utilizes modules with inexpensive diodes and resistors, and is conveniently and easily added to existing burglar alarm circuits and loops. A monitoring module that includes a diode and a paralleled resistor is connected across each switch. First and second interrogating signals are alternately applied to the protection loop. First comparator circuit means provides an output in response to each first interrogating signal when one of the monitored switches in the protection loop is open as indicated by the response of the module resistors; and second comparator circuit means provides an output in response to each second interrogating signal when more than one of the monitored switches in the protection loop is open as indicated by the response of the module diodes.

15 Claims, 2 Drawing Figures

MONITORING SYSTEM

Figure 1:
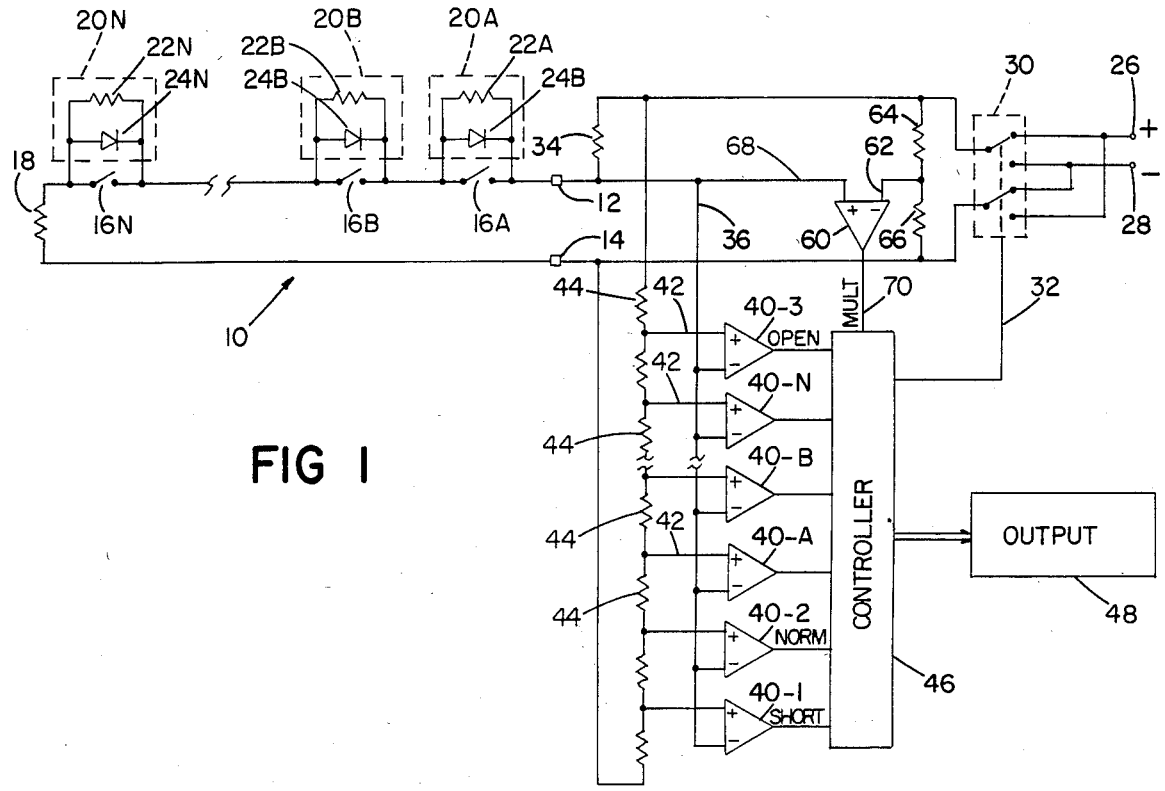

This invention relates to monitoring systems and more particularly to systems for monitoring a plurality of conditions such as a security system which employs a plurality of switches (door or window and the like).

In a typical burglar alarm system, a plurality of window or door switches are connected in series in a protection loop that is supplied with a constant DC current. Loop monitoring systems are capable of signifying an alarm condition if one of the switches is in open condition. While an alarm condition in the entire loop can be detected, there is no means in a simple monitoring system of this type for determining which contact (or correspondingly which door or window) was the source of the alarm condition. More complex annunciator modules have been proposed to identify which contact in a number of series contacts is open. However those monitoring systems suffer from substantial limitations. For example in one such system, series resonant circuits are placed across each of the several switch contacts being monitored and a variable frequency signal generator is connected at one end of the loop. The resonant peaks corresponding to each tuned circuit are monitored to indicate which contact is open. Such tuned resonant tank circuits are expensive and the monitoring system requires complex signal generation and detection circuitry. In another monitoring system, specially selected resistors are placed in parallel with each of the switches being monitored. These resistors are selected such that voltages resulting from individual switch closures or openings have a specified binary relationship, thereby enabling cooperating detector circuitry to distinguish between different switch openings. A voltage in the voltage divider circuit must be unique for every combination of switch openings but, in order to maintain a binary relationship throughout the system, very few contacts are possible. The complexity of the resistances in such binary circuits increases rapidly and the tolerance of a large resistor may in fact be greater than the entire value of a lower value resistor. Also, the actual line impedence of the loop may be a signficant resistance factor.

The present invention provides a low cost and reliable monitoring system for detecting which switch in a series of switches is in open condition, and also indicating whether a multiple open contact condition exists. In accordance with the invention, there is provided a monitoring system for a protection loop that has a plurality of switches in series. A monitoring module that includes a first device that has an asymmetric response characteristic and a second device that has a symmetrical response characteristic is connected across each switch. The first and second devices are connected in parallel with one another, and the second devices have a graduated series of different values with the value of each second device being different from the value of any combination of the other second devices. Further, the modules are connected across the switches so that each first device is poled in the same direction. First and second interrogating signals are alternately applied to the protection loop, each first device having a response to each first interrogating signal that is less significant than the response of its paralleled second device to said first interrogating signal and a response to said second interrogating signal that is more significant than the response of its paralleled second device to the second interrogating signal. First comparator circuit means is operative to provide an output in response to the first interrogating signal when one of the monitored switches in the protection loop is open as indicated by the response of the second devices to the first interrogating signal; and second comparator circuit means is operative to provide an output in response to each second interrogating signal when more than one of the monitored switches in the protection loop is open as indicated by the response of the first devices to the second interrogating signal. The system also includes means responsive to the outputs of the comparator circuit means for indicating the status of the monitored switches in the protection loop.

In a particular embodiment, each switch of the plurality of monitored switches is shunted by a diode-resistor combination. Detector means are provided to distinguish between the voltage drops from any one of the switch contacts in open condition and alternately the detector circuitry determines whether a multiple open contact condition exists. The monitoring system is able to detect, isolate and annunciate various individual switch openings on a multiple switch condition, utilizes inexpensive diodes and resistors, and is conveniently and easily added to existing burglar alarm circuits and loops.

Figure 2:
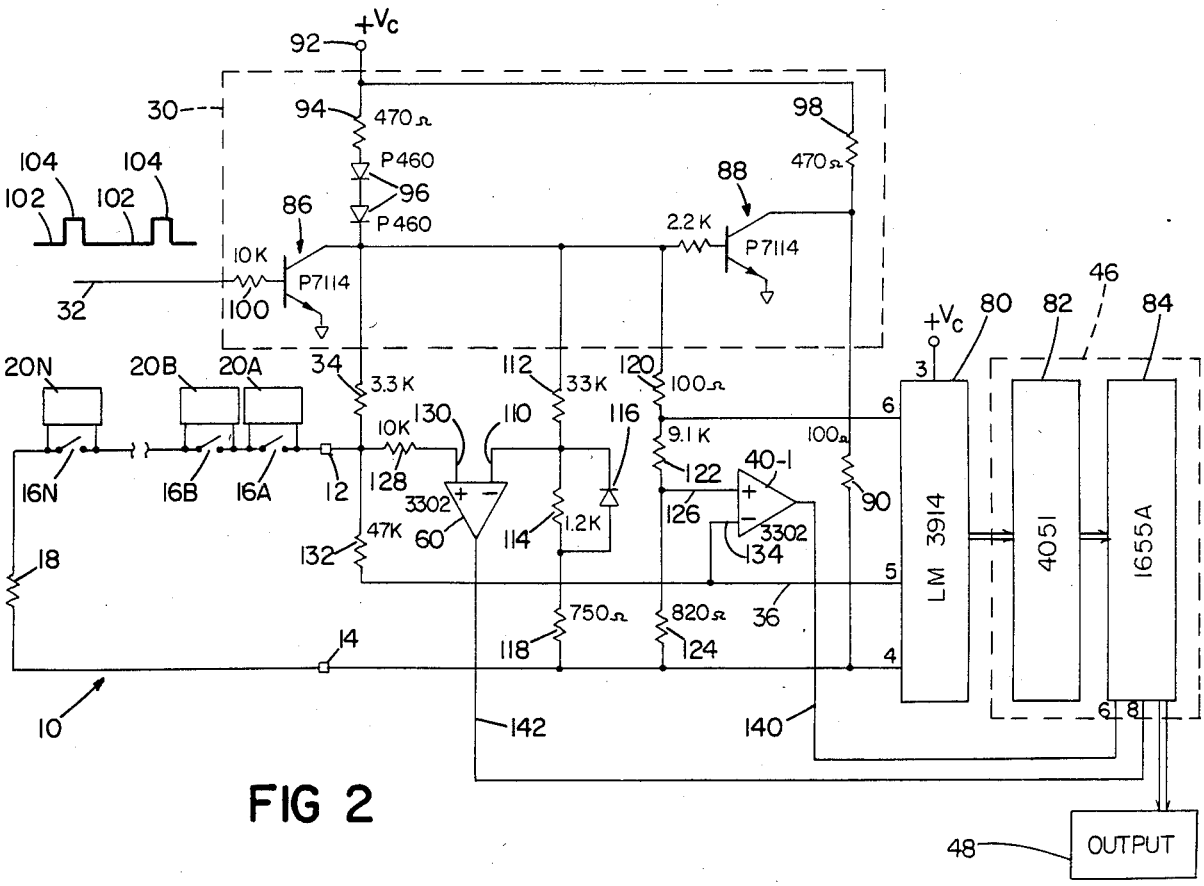

Other features and advantages of the invention will be seen as the following description of a particular embodiment, progresses, in conjunction with the drawing, in which:

FIG. 1 is a schematic diagram of a monitoring system in accordance with the invention; and FIG. 2 is a schematic diagram showing further aspects of the monitoring circuit shown in FIG. 1.

DESCRIPTION OF PARTICULAR EMBODIMENT

With reference to FIG. 1, protection loop 10 is connected to monitoring circuitry at terminals 12, 14. Connected in loop 10 are a series of switches 16A–16N, and an end of line resistor 18. Each switch 16 is shunted by a module 20 that includes a symmetrically conductive device—resistor 22—and an asymmetrically conductive device—diode 24. In this particular embodiment, diodes 24 are Type 1N4001 and resistors 18 and 22 have graduated values as set out in the following table:

| Resistor | Value (ohms) |
|---|---|
| 18 | 430 |
| 22A | 619 |
| 22B | 1210 |
| 22C | 2050 |
| 22D | 3320 |
| 22E | 5620 |
| 22F | 9530 |
| 22G | 16.2K |
| 22H | 40.2K |

A DC voltage is supplied at terminals 26, 28 (either six volts or twelve volts in particular embodiments) and applied through switching network 30 to protection loop terminals 12, 14. A driving signal applied to switching network 30 over line 32 alternately operates switch circuit 30 to apply a positive voltage to terminal 12 in a first state and to terminal 14 in a second state. During the first state when the positive voltage is applied to terminal 12, each monitoring diode 24 is reverse biased and not active in the circuit, and a voltage dividing network is formed that includes resistor 34 and end of line resistor 18, producing an output voltage on line 36. In that first interrogating condition, if any switch 16 is open, its monitoring resistor 22 is in circuit such that the voltage dividing network, formed with resistor 34 and end of line resistor 18, is modified to include the resistor 22 shunting the open switch 16 and to correspondingly modify the output voltage on line 36.

Connected to line 36 are a series of comparator circuits 40 that have reference inputs over lines 42 from a reference voltage divider network that is composed of resistors 44. If none of switches 16 is open, the voltage on line 36 is a function of value of resistor 34 and end of line resistor 18 and comparators 40-1 and 40-2 have outputs that are applied to controller circuitry 46 for energization of a corresponding indicator in output unit 48 (for example, a display panel). If a switch 16 is open, the comparator 40 corresponding to that switch produces an output to controller 46 for energization of its corresponding indicator in output unit 48. Similarly, if the protection loop is shorted, the voltage on line 36 will drop and only comparator 40-1 will produce an output and a corresponding indicator will be energized; while if the protection loop is open circuited, the voltage on line 36 will rise and all the comparators, including comparator 40-3, will produce an output, the resulting outputs being decoded by controller 46 to energize a corresponding indicator in output unit 48.

When controller 46 generates a control signal on line 32 to operate switching circuit 30 to reverse the polarity of the potentials applied to loop terminals 12, 14, a positive potential is applied to terminal 14, and diodes 24 become forward biased and produce uniform voltage drops that are more significant than the voltage drop produced by any of the shunting resistors 22. Whenever a switch 16 is open, the specific voltage drop resulting from the forward biased condition of its shunting diode 24 is inserted into the loop 10. If more than one switch 16 is open, the resulting diode voltage drops will be additive and correspond to the sum of the voltage drops across the individual diodes 24 active in the loop circuit. Voltage comparator 60 has a reference input on line 62 from a voltage divider circuit that includes resistors 64 and 66. That reference voltage is less than the voltage on line 68 when fewer than two switches 16 are open, and more than the voltage on line 68 when more than one switch 16 is open. If the voltage on comparator input 68 is less than the reference voltage on input 62, comparator 60 has an output on line 70 to controller 46 which energizes a corresponding indicator in display or output circuit 48 to indicate or signal the fact that more than one switch 16 in the monitored protection loop 10 is in open condition. Depending on particular design parameters, the controller 46 may uniquely differentiate a first fault indication from subsequent faults as by a distinctive LED indication of the first fault, the indicator being steadily energized while the disturbance is present and rapidly flashing if the contact is restored or if additional contacts in the loop are disturbed while the first contact remains disturbed. Should two contacts be disturbed concurrently, the first disturbed contact indicator may be uniquely identified and the existance of a second disturbance noted by the multiple contact indicator being energized. If the disturbances are subsequently restored, memory of those disturbances may be indicated by slowly flashing indicators. Similar indicator energization may be utilized in response to detection of an open circuit or a short circuit, the indicator being continuously energized while the defect remains and intermittently energized after the defect is removed and the operating condition of the protection loop restored.

FIG. 2 shows further details of the embodiment of FIG. 1. The comparators 40 are included in an integrated circuit 80—a bar display driver device with a series of voltage comparators in an equal division configuration. Circuit 80 applies output signals to controller 46 that includes multiplexer 82 and microprocessor 84 which controls the energization of indicators in output circuitry 48. Switching network 30 includes transistors 86 and 88, the collector of transistor 86 being connected to loop terminal 12 through resistor 34 and the collector of transistor 88 being connected to loop terminal 14 through resistor 90. DC voltage at terminal 92 is applied through resistor 94 and diodes 96 to transistor 86 and through resistor 98 to transistor 88. A switching signal on line 32 from controller 46 is applied to the base of transistor 86 through resistor 100 and alternately has negative interval 102 (of fifteen or three-hundred millisecond duration) and positive interval 104 (of three millisecond duration). During the first interval 102, transistor 86 is nonconductive (so that a positive voltage is applied to terminal 12) and transistor 88 is conductive (applying a negative or ground potential to terminal 14).

Connected to switching network 30 and protection loop 10 are monitoring comparators 40-1 and 60 and comparator unit 80. A reference voltage is applied to terminal 110 of comparator 60 by a voltage divider network that includes resistor 112, resistor 114 shunted by diode 116 and resistor 118. A similar voltage divider network that includes resistors 120, 122 and 124 applies a reference signal to terminal 126 of comparator 40-1. The loop condition signal from terminal 12 is applied through resistor 128 to input 130 of comparator 60 and through resistor 132 to input 134 of comparator 40-1 and to input 36 of comparator unit 80.

During the first monitoring interval (102), a positive voltage is applied to loop terminal 12 and the output voltage is applied to the comparators of unit 80 and to comparator 40-1. In this condition, if all the monitored switches 16 in protection loop 10 are closed, comparator 40-2 in unit 80 has an output. If one of the switches 16 is open, the voltage applied at terminal 36 triggers a comparator output corresponding to that switch that is applied to controller 46 to energize the corresponding indicator in the output circuit 48. Similarly, if the voltage on line 36 should fall below a reference value (due to a short on protection loop 10, for example), only comparator 40-1 will produce an output on line 140 for application to controller 46 which in turn energizes an appropriate indicator to indicate the fault condition.

During each alternate interval 104, transistor 86 is conducting (applying a ground condition to loop terminal 12 through resistor 34), and transistor 88 is nonconducting (applying a positive voltage to loop terminal 14 through resistor 90). In this condition, diodes 24 in modules 20 are connected in active relation in the circuit and are normally shunted by the closed switches 16, but insert a voltage drop into the circuit whenever the shunted switch is open. If more than one switch 16 is open, the voltage applied at terminal 130 of comparator 60 is less than the voltage at reference input 110 and comparator 60 produces an output on line 142 for application to controller 46 which in turn energizes an appropriate indicator to indicate the fault condition.

While a particular embodiment has been shown and described, various modifications will be apparent to those skilled in the art and therefore it is not intended that the invention be limited to the disclosed embodiment or to details thereof and departures may be made therefrom within the spirit and scope of the invention.

What is claimed is:

1. A monitoring system for a protection loop that has a plurality of switches in series comprising a monitoring module connected across each said switch, each said monitoring module including first and second devices connected in parallel with one another, each said first device having an asymmetric response characteristic and each said second device having a symmetrical response characteristic, said modules being connected across said switches so that each said first device is poled in the same direction, means to apply first and second interrogating signals alternately to said protection loop, each said first device having a response to said each first interrogating signal that is less significant than the response of its paralleled second device to said first interrogating signal and a response to said second interrogating signal that is more significant than the response of said paralleled second device to said second interrogating signal;

first comparator circuit means operative to provide an output in response to said first interrogating signal when one of said monitored switches in said protection loop is open as indicated by the response of said second devices to said first interrogating signal, and second comparator circuit means operative to provide an output in response to said second interrogating signal when more than one of said monitored switches in said protection loop is open as indicated by the response of said first devices to said second interrogating signal, and means responsive to the outputs of said comparator circuit means for indicating the status of said monitored switches in said protection loop.

2. The monitoring system of claim 1 wherein each said first device is a diode.

3. The monitoring system of claim 1 wherein each said second device is a resistor.

4. The monitoring system of claim 3 wherein said resistors have a graduated series of different values with the value of each said resistor being different from the value of any combination of the other said resistors.

5. The monitoring system of claim 1 wherein said interrogating signal applying means alternately applies opposite polarity voltages to said protection loop.

6. The monitoring system of claim 1 wherein said first comparator circuit means includes a plurality of comparator circuits with one of said comparator circuits providing an open protection loop indication, another of said comparator circuits providing a shorted protection loop indication, and a plurality of comparator circuits corresponding to said switches.

7. The monitoring system of claim 1 wherein said first comparator circuit means includes a plurality of comparator circuits with a voltage divider network that includes a corresponding plurality of equal value resistors.

8. The monitoring system of claim 1 wherein said second comparator circuit means includes a comparator circuit with a voltage divider reference network that is proportioned to cause said second comparator circuit means to produce an output when more than one of said switches are open.

9. A system for monitoring a plurality of switches connected in series comprising a monitoring module for connection across each said switch, each said monitoring module including first and second devices connected in parallel with one another, each said first device having an asymmetric response characteristic and each said second device having a symmetrical response characteristic, said modules being adapted to be connected across said switches so that each said first device is poled in the same direction, means for alternately applying first and second interrogating signals to said series of switches, first comparator circuit means operative to provide an output in response to said first interrogating signal when one of said monitored switches in said series of switches is open, and second comparator circuit means operative to provide an output in response to said second interrogating signal when more than one of said monitored switches in said series of switches is open, and means responsive to the outputs of said first and second comparator circuit means for indicating the status of said monitored switches in said series of switches.

10. The monitoring system of claim 9 wherein each said first device is a diode and each said second device is a resistor.

11. The monitoring system of claim 10 wherein said resistors have a graduated series of different values with the value of each said resistor being different from the value of any combination of the other said resistors.

12. The monitoring system of claim 11 wherein said interrogating signal applying means alternately applies opposite polarity voltages to said protection loop.

13. The monitoring system of claim 12 wherein said second comparator circuit means includes a comparator circuit with a voltage divider reference network that is proportioned to cause said second comparator circuit means to produce an output when more than one of the monitored switches is open.

14. The monitoring system of claim 13 for use with a protection loop in which said switches are connected in series wherein said first comparator circuit means includes a plurality of comparator circuits with one of said comparator circuits being adapted to provide an open protection loop indication, another of said comparator circuits being adapted to provide a shorted protection loop indication, and a plurality of comparator circuits corresponding to the switches to be monitored.

15. The monitoring system of claim 14 wherein said first comparator circuit means includes a plurality of comparator circuits with a voltage divider network that includes a corresponding plurality of equal value resistors.

* * * * *